United States Patent [19]

Porosoff

[11] 4,163,770

[45] Aug. 7, 1979

[54] MELT-SPINNING ACRYLONITRILE POLYMER FIBERS

[75] Inventor: Harold Porosoff, Scarsdale, N.Y.

[73] Assignee: American Cyanamid Company, Stamford, Conn.

[21] Appl. No.: 938,200

[22] Filed: Aug. 30, 1978

Related U.S. Application Data

[60] Continuation-in-part of Ser. No. 803,005, Jun. 3, 1977, abandoned, which is a continuation-in-part of Ser. No. 698,566, Jun. 22, 1976, abandoned, which is a continuation-in-part of Ser. No. 349,877, Apr. 10, 1973, abandoned, which is a division of Ser. No. 344,463, Mar. 23, 1973, abandoned, which is a continuation-in-part of Ser. No. 337,506, Mar. 2, 1973, abandoned, which is a continuation-in-part of Ser. No. 329,479, Feb. 5, 1973, abandoned.

[51] Int. Cl.[2] ..... D01F 7/00

[52] U.S. Cl. ..... 264/210.3; 264/206; 264/211; 264/342 RE

[58] Field of Search ..... 264/206, 211, 210 F, 264/342 RE

[56] References Cited

U.S. PATENT DOCUMENTS

| | | | |
|---|---|---|---|
| 2,585,444 | 2/1952 | Coxe | 264/182 |
| 3,896,204 | 7/1975 | Goodman et al. | 264/29.6 AU |
| 3,984,601 | 10/1976 | Blickenstaff | 428/364 |

*Primary Examiner*—Jay H. Woo
*Attorney, Agent, or Firm*—William J. van Loo

[57] ABSTRACT

A single phase fusion melt of an acrylonitrile polymer and water is extruded into a steam-pressurized solidification zone maintained under conditions such that the continuous filament resulting retains sufficient plasticity so that stretching can be effected at a stretch ratio of at least about 25 relative to the linear speed of the single phase fusion melt through the spinnerette.

6 Claims, 5 Drawing Figures

F
G
B
C
I
II
III
IV
D
A
TEMPERATURE °C
0
% WATER
10

F
G
B
C
A
E
225
200
175
150
125
TEMPERATURE °C
10
20
30
40
50
60
% WATER 225
200
175
150
125
TEMPERATURE °C
F
G
B
C
A
E
10
20
30
40
50
60
% WATER 225
200
175
150
125
TEMPERATURE °C
F
G
B
C
A
E
10
20
30
40
50
60
% WATER

MELT-SPINNING ACRYLONITRILE POLYMER FIBERS

CROSS-REFERENCE TO RELATED APPLICATIONS

This application is a continuation-in-part of application Ser. No. 803,005, filed June 3, 1977, now abandoned, which application is, in turn, is a continuation-in-part of application Ser. No. 698,566, filed June 22, 1976, now abandoned, which application is, in turn, is a continuation-in-part of application Ser. No. 349,877, filed Apr. 10, 1973, (now abandoned), which application is, in turn, a division of application Ser. No. 344,463, filed Mar. 23, 1973 (now abandoned), which application is, in turn a continuation-in-part of application Ser. No. 337,506, filed Mar. 2, 1973 (now abandoned), which application is, in turn, a continuation-in-part of application Ser. No. 329,479, filed Feb. 5, 1973 (now abandoned).

This invention relates to an improved process for preparing acrylonitrile polymer fiber. More particularly, this invention relates to such a process wherein a single phase fusion melt of acrylonitrile polymer and water is extruded at elevated temperature and pressure through a spinnerette directly into a steam-pressurized solidification zone maintained under suitable conditions to provide a stretchable nascent extrudate which is stretched sufficiently while in said solidification zone to provide an oriented acrylonitrile polymer fiber which is subsequently dried.

Acrylonitrile polymer fibers are currently provided commercially by wet or dry spinning procedures wherein the polymer is dissolved in a suitable solvent and extruded into a medium which solidifies the polymer in fiber form. When the solidification medium is a heated gas which causes evaporation of the polymer solvent, the process is that of dry spinning. When the coagulating medium is a liquid which dilutes and washes out the polymer solvent, the process is that of wet spinning. While such processes provide desirable fibers, their requirement for use of a polymer solvent is undesirable due to the problem of solvent removal and recovery. The solvents employed are of such a nature as to contribute to process costs and to cause environmental pollution problems if not recovered from the process. Removal of polymer solvent from the resulting fiber is not always complete at the completion of the fiber-making process and residual solvent may be exuded in subsequent hot-wet fiber treatments, such as dyeing, thus giving rise to the environmental problems subsequent to the fiber making process. Therefore, it would be beneficial to extrude acrylonitrile polymer-water mixtures since this would eliminate the steps and costs expended in solvent recovery and eliminate the pollution problems associated therewith.

It was previously known from U.S. Pat. No. 2,585,444, issued Feb. 12, 1952 to C. D. Coxe that mixtures of acrylonitrile polymer and water when extruded under conditions of elevated temperature and pressure resulted in fibrillar materials suitable for making paper, or in strands of fused and sintered or foamed particles. They have not resulted in filaments suitable for textile purposes as is stated in U.S. Pat. No. 3,984,601, issued Oct. 5, 1976 to R. H. Blickenstaff, and assigned to the same assignee as the Coxe patent. Coxe clearly failed to teach the requirement for a specific amount of water to provide a single phase fusion melt. As a result, the product obtained is sintered, non-homogeneous, pockmarked, and has poor elongation, low-tenacity, and poor properties in general with respect to textile applications.

In U.S. Pat. No. 3,388,202 issued June 11, 1968 to R. E. Opferkuck, Jr., and O. C. Ross, it is disclosed that acrylonitrile polymers can be converted into a melt phase by heating such a polymer in the presence of moisture to elevated temperatures above the boiling point of water and compressing at pressures above atmospheric to prevent water from boiling. However, the patentees state that when high pressures are employed, it is difficult to perform some extrusion operations, such as spinning textile filaments. The patent then teaches the use of a latent solvent for the polymer that has a high dielectric constant and a high boiling point to obviate the use of pressure. Although the patent states that textile filaments can be spun from the melt by conventional melt spinning techniques, the filaments of textile denier provided by the reference do not have acceptable physical properties for textile purposes and the problems created by solvent use have not been overcome.

In the Blickenstaff patent cited above, there are disclosed films and filaments spun from substantially single-phase compositions comprising polymers or copolymers of at least 80% or more of acrylonitrile. The filaments are characterized by a sheath-core structure, a density gradient across the sheath, a striated surface, and a luster source ratio related to reflective surfaces. It is not indicated what advantages in fiber properties result from this combination of characteristics. The process involves preparing a single-phase fusion melt and extruding such melt into the atmosphere or a spinning chamber pressurized with air or air-water vapor. Filament stretching is done in a separate step by drawing in saturated steam after the initial take-up of the filaments in conjunction with extrusion. Fiber properties in the range of deniers suitable for textile applications are deficient, particularly with respect to loop properties, except when using small amounts of added polymer solvent.

In U.S. Pat. No. 3,896,204, issued July 22, 1975 to A. Goodman and M. A. Suwyn, there is disclosed a process for improving the loop properties of the Blickenstaff fiber by incorporating a small amount of a compatible solvent for the polymer. Processing details are the same as those given by Blickenstaff. While the loop properties are improved somewhat by the incorporation of a compatible solvent in the fusion melt, the requirement for such polymer solvent gives rise to the pollution or recovery problems previously discussed.

Thus, while there has been certain activity with respect to melt spinning acrylonitrile polymer fibers, there still remains the need for improved processes for melt-spinning acrylonitrile polymer fiber that provide processing advantages and fiber of desirable properties for textile uses, avoid the need for polymer solvent in processing, and reduce energy requirements for processing. Such a process would fulfill a long-felt need and constitute a notable advance in the art.

In accordance with the present invention, there is provided a process for preparing an acrylonitrile polymer fiber which comprises extruding a single phase fusion melt of an acrylonitrile copolymer and water through a spinnerette directly into a steam-pressurized solidification zone wherein the temperature, pressure, and saturation of steam are maintained so that the nascent extrudate in the form of a filament solidifies, remains in a stretchable state sufficient to achieve a total stretch ratio of at least about 25, relative to the linear flow of said fusion melt through said spinnerette, and the amount of water retained in said filament is sufficient to maintain the nascent filament in a plastic state; stretching said nascent filament while in said solidification zone at a total stretch ratio of at least about 25 relative to the linear flow of said fusion melt through said spinnerette; and thereafter drying the resulting filament.

The process of the present invention is free of the requirement for polymer solvent and, therefore, avoids the pollution or recovery problems associated therewith. The process minimizes energy requirements by effecting stretching in a steam-pressurized solidification zone into which the filament enters directly from the spinnerette while the filament is still hot, thus enabling that the stretching to be done can be accomplished without the need to cool the extrudate and later reheat to effect the stretching. In other words by conducting stretching in conjunction with extrusion, the present invention eliminates the necessity for a separate step directed specifically to stretching. The present process, by maintaining the nascent filament in a stretchable state while it remains in the solidification zone, enables a wide variety of stretch ratios to be obtained and consequently, enables a wide variety of fiber deniers to be achieved with a given spinnerette orifice size. By solidifying the nascent filament in the steam-pressurized solidification zone, evaporation of water therefrom is controlled to provide an improved fiber structure compared to that obtained in other melt-spinning processes for acrylonitrile-water compositions. The present process also provides fiber of desirable properties for textile uses without the need for solvent compared to fibers prepared by other melt-spinning processes.

One of the important features of the process of the present invention involves the conditions that are maintained in the steam-pressurized solidification zone into which the fusion melt is directly spun. The specific conditions that are maintained are those which effect solidification of the molten polymer composition but maintain the nascent filament in a readily stretchable state. By a "readily stretchable state" is meant that the nascent filament can be drawn at a stretch ratio of at least about 25 relative to the linear flow of fusion melt through the spinnerette without breakage of a significant number of filaments being processed. The specific conditions that enable the desired stretch ratio to be accomplished are such that the temperature is less than the melting temperature of the fusion melt, but high enough to provide the necessary stretchability; the steam pressure maintained in the solidification zone is sufficient to provide the necessary temperature for the nascent filament and to maintain the rate of evaporation of water from the nascent filament substantially equal to the rate of diffusion of water vapor through the nascent filament so as to maintain a substantially uniform composition profile across the cross-section of the nascent filament while it is within the solidification zone; and the steam used to pressurize the solidification zone is of sufficient temperature and saturation to maintain the surface layer of the nascent filament sufficiently moist to minimize the rate of skin formation thereon. An alternative manner for describing the temperature of the nascent filament while it is within the steam-pressurized solidification zone and in stretchable state is that it is at a temperature below the minimum melting point of the fusion melt but above the second order glass transition temperature, that is, it is neither melted nor rigidly set, but remains in a plastic state.

If the conditions in the solidification zone are maintained as indicated, the nascent filament while in the solidification zone will be stretchable at a stretch ratio of at least about 25 and, generally, in the range of stretch ratios of about 25 to 250, preferably about 50 to 150. By maintaining the proper temperature in the solidification zone, the nascent filament will remain in a plastic state suitable for obtaining the desired stretch ratio. Maintaining the proper steam pressure in the solidification zone will not only provide the necessary temperature to maintain the nascent filament in a stretchable state but will also maintain a relatively uniform water content within the composition of the nascent filament to enhance stretchability thereof. The use of steam of sufficient temperature and saturation will maintain the surface layer of the nascent filament moist so as to minimize the rate of skin formation and enable high stretch to be achieved, while at the same time providing a relatively smooth surface on the filament resulting. It is believed that the single most deleterious factor affecting stretching of the nascent filament is the premature drying out of the surface layer thereof which leads to a significant skin, or sheath, layer of polymer composition on the filament that resists stretching. When this occurs, additional steps of after-drawing, after-stretching, or other treatment are necessary to effect minimal orientation of the filament for textile processing, thus complicating processing and increasing energy requirements without providing the good fiber properties obtained by the process of the present invention.

As indicated above, the conditions to be maintained in the steam-pressurized solidification zone are those that provide the nascent filament in a stretchable state such that the filament can be drawn at a stretch ratio of at least about 25 relative to the linear flow of fusion melt through the spinnerette. It is not possible to specify in any generic manner what ranges of actual steam pressure are required for each and every acrylonitrile polymer composition contemplated by the present invention because such pressures are influenced by many variables such as the polymer composition, the molecular weight of the polymer and its distribution, the water content of the single phase fusion melt, and the like. These specific variables individually affect differently the steam pressure requirements among the useful acrylonitrile polymers contemplated with the result that any broad range of steam pressures recited would inherently encompass certain areas of such range wherein many of the acrylonitrile polymers contemplated would individually be inoperative. Conversely, a statement of a narrow range of pressures operative with certain selected acrylonitrile polymers would fail to properly indicate those operative steam pressures for numerous other acrylonitrile polymers processable by the present invention. Thus, the range of effective pressures useful with certain copolymers of acrylonitrile extends well beyond the range of effective pressures useful with other copolymers of acrylonitrile. Even with copolymers of the same comonomers, the steam pressure requirements vary widely as comonomer contents vary. Therefore, the only accurate manner to obtain the steam pressure necessary in the steam pressurized solidification zone to achieve the specified stretching is to determine the same by experimentation following the principles given herein.

For example, the following tabulation indicates the steam pressure ranges necessary for processing copolymers of acrylonitrile (AN) and methyl methacrylate (MMA) in which the proportions of the comonomers vary but processing is carried out in identical manner in accordance with the present invention, percentages by weight:

Processing Conditions for Various AN/MMA Copolymers

| Copolymer | | Melt Temp. | Solidification Zone | Steam Pressure |
|---|---|---|---|---|
| AN(%) | MMA(%) | Minimum °C. | PSIG | % of PM[1] |
| 85.5 | 14.5 | 148 | 20–35 | 40–70 |
| 89.3 | 10.7 | 154 | 30–46 | 50–75 |
| 92.0 | 8.0 | 161 | 40–55 | 53–75 |

Note: [1]PM equals saturated steam pressure (PSIG) equivalent to Minimum Melt Temperature °C.

From the above tabulation, it can be readily seen that as the composition of the copolymer varies, the steam pressures required for a particular copolymer vary and a pressure range specified for one copolymer would not be entirely suitable for another copolymer. Similar comparisons for other copolymers involving different comonomers, among themselves or taken with other different copolymers, do not lead to a generic expression of the useful operating steam pressures in the solidification zone that is pertinent for all acrylonitrile polymer compositions contemplated.

The conditions to be maintained in the solidification zone, as indicated above, are those obtained by employing steam of sufficient pressure and saturation therein. The exact steam pressure will be influenced by the various other conditions selected, as indicated, and is selected to achieve the necessary draw-down or stretch within the solidification zone to achieve sufficient orientation to provide textile fiber, i.e., fiber having sufficient orientation to provide those properties useful in textile applications and deniers in the range of about 1 to 20. The steam pressure is generally at a value which will allow a draw-down or stretch of at least about 25, preferably about 50 to 150, relative to the linear flow of fusion melt through the spinnerette.

Although the specific steam pressures used in the solidification zone cannot be specified with particularity to cover all of the individual acrylonitrile polymers contemplated by the present invention because of the wide divergency in pressure ranges peculiar to specific polymers, nevertheless, the effective range will generally be found within the broad range of about 5 to 125 pounds per square inch gauge (PSIG). The steam pressure required will generally increase as the melting point of the polymer-water mixture increases. As a result, it is sometimes possible to arrive at the specific pressure value as a percentage of the steam pressure corresponding to the minimum melting point of the polymer-water mixture. As a rule, the useful steam pressure will generally fall in the range of about 30 to 95 percent of the steam pressure corresponding to that equivalent to the minimum melting point.

As can be appreciated from the above discussion of the conditions maintained in the steam-pressurized solidification zone, three essential features of the nascent filament must be maintained to achieve the desired stretch ratio within the solidification zone, i.e., its temperature, its water content, and the distribution of its water content throughout its filament structure. The acrylonitrile polymer alone does not have the capability of forming a melt at a temperature below its deterioration or degradation temperature. Water is necessary to achieve the melt at safe temperatures below those at which deterioration or degradation becomes significant. Once the composition of polymer and water has been heated to a sufficient yet safe temperature, a new entity arises which is a homogeneous melt of polymer and water. Processability of this new entity within the steam-pressurized solidification zone is influenced by the three essential features mentioned. The temperature must be low enough to solidify the melt but high enough to maintain the composition in plastic state. The water content must be sufficient to provide a plastic state at the temperature at which processing is to be conducted. The water content must also be uniformly distributed throughout the extrudate composition so that uniform plasticity is provided throughout the extrudate structure. The present invention conducts processing to obtain orientation stretching within the solidification zone under conditions such that the temperature, water content, and distribution of water content are optimized to achieve such processing.

Another important feature of the process of the present invention is that of effecting the necessary total stretch within the steam-pressurized solidification zone maintained under conditions as discussed above. To obtain a suitable degree of orientation to provide desirable textile properties, it is generally necessary to effect a stretch ratio of at least about 25 relative to the linear flow of the fusion melt through the spinnerette, preferably a stretch ratio of about 50 to 150. The stretch may be obtained in one or more stages so long as all stretching is effected within the steam-pressurized solidification zone. When two stages are employed, the first stage should be at a stretch ratio of about 5 to 150 and the second stage at about 1.1 to 30.

The process of the present invention provides acrylonitrile polymer fiber without the use of any polymer solvent and provides improved physical properties over other acrylonitrile polymer fiber melt-spun by prior art processes without polymer solvent. Thus, the process of the present invention eliminates the pollution or recovery problems that processes employing polymer solvents create. The present invention by effecting orientation stretching in conjunction with solidification of the polymer melt eliminates the need for subsequent stretching steps and the equipment and power requirements therefor. By controlling the solidification of the nascent filament in a steam-pressurized atmosphere, evaporation of water therefrom is controlled to provide an improved fiber structure compared to that obtained in other melt-spinning processes for acrylonitrile polymer-water compositions. By providing the high levels of orientation in the steam-pressurized solidification zone, the present process enables a wide range of finer denier to be provided using spinnerette orifices of a given size. Thus, not only does the process of the present invention provide numerous process advantages, as indicated, but it also provides superior acrylonitrile polymer fiber melt-spun in the absence of any polymer solvent.

The acrylonitrile polymers which are useful in the practice of the process of the present invention are those which have fiber-forming properties and form single phase fusion melts with water under autogeneous pressure at temperatures above the boiling point of water at atmospheric pressure and below the temperature at which significant decomposition of the polymer occurs. The acrylonitrile polymers comprise homopolymers and copolymers of acrylonitrile. Respecting the copolymers, they will generally contain from about 50 to 99 weight percent of acrylonitrile and, correspondingly, from about 50 to 1 weight percent of one or more copolymerizable monomers. Preferably the acrylonitrile copolymer will contain from about 75 to about 95 weight percent of acrylonitrile and, correspondigly, from about 25 to 5 weight percent of one or more copolymerizable monomers. Such monomers include acrylic, alpha-chloroacrylic, and methacrylic acids, the methacrylates, such as methyl methacrylate, ethyl methacrylate, butyl methacrylate, methoxymethyl methacrylate, betachloroethyl methacrylate and the corresponding esters of acrylic and alpha-chloroacrylic acids; vinyl bromide, vinyl chloride, vinyl fluoride, vinylidene chloride, vinylidene bromide, allyl chloride, 1-chloro-1-bromoethylene; methacrylonitrile; allyl alcohol; acrylamide and methacrylamide; methyl vinyl ketone, vinyl carboxylates such as vinyl formate, vinyl acetate, vinyl propionate, vinyl stearate, and vinyl benzoate; N-vinylimides such as N-vinylphthalimide and N-vinylsuccinimide; methylene malonic esters; itaconic acid and itaconic esters; N-vinylcarbazole; vinyl furan; alkyl vinyl ethers; vinyl sulfonic acids such as vinyl sulfonic acid, styrene sulfonic acid, methallyl sulfonic acid, p-methoxyallylbenzene sulfonic acid, acrylamidomethylpropane sulfonic acid and their salts; ethylene alpha- beta-dicarboxylic acids and their anhydrides or derivatives such as diethyl citraconate, diethylmesaconate, styrene, dibromostyrene; vinylnaphthalene; vinyl-substituted tertiary heterocylic amines cuch as the vinylpyridines and alyl-substituted vinylpyridines, for example, 2-methyl, 5-vinylpyridine, 2-vinylpyridine, 4-vinylpyridine, and the like; 1-vinylimidazole and alkyl-substituted 1-vinylimidazoles, such as 2-, 4-, or 5-methyl, 1-vinylimidazole, vinylpyrrolidone; vinylpiperidone; and other mono-olefinic copolymerizable monomeric materials. The acrylonitrile polymer or blend of polymers may contain varying quantities of one or more comonomers as for example, a total of about 5, 10, 15, 20, 25, 30, 40 or 50 weight percent comonomer content based on the total acrylonitrile polymer composition and may have viscosity related molecular weights ranging from about 30,000 to 200,000, as for example about 30,000; 40,000; 50,000; 60,000; 70,000; 85,000; 100,000; 130,000; etc. The quantity of comonomers and the molecular weights may vary outside these indicated ranges since the present invention does not depend upon these features for operability although consideration of the properties of the products for their end uses may suggest such variations.

The deterioration range for acrylonitrile polymer as used herein refers to the range of temperatures wherein acrylonitrile polymers undergo deterioration such as degradation or decomposition, usually evidenced by discoloration on exposure to such temperatures for the time normally required for fluidizing and extruding the polymer. This deterioration range may start at about 180° C. to 220° C., depending upon the polymer composition, etc., and extends upwardly therefrom. Where the quality of the polymer in the product is not critical and some polymer degradation can be tolerated, the single phase fusion melt may be heated to more elevated temperatures into the degradation range in the practice of this invention, however, in general, it is preferred to operate at lower temperatures to avoid degradation.

As indicated above, for processing, water is used in conjunction with the acrylonitrile polymer to provide a single phase fusion melt at a temperature above the boiling point of water at atmospheric pressure and below the deterioration point of the acrylonitrile polymer, the pressure being at least sufficient to maintain water in liquid state. In carrying out the process of the present invention, the determination of the quantity of water necessary to provide a single phase fusion melt can be readily accomplished by preparing a phase diagram of water and acrylonitrile polymer.

The present invention is described with particular reference to the accompanying drawings in which.

Figure 1:
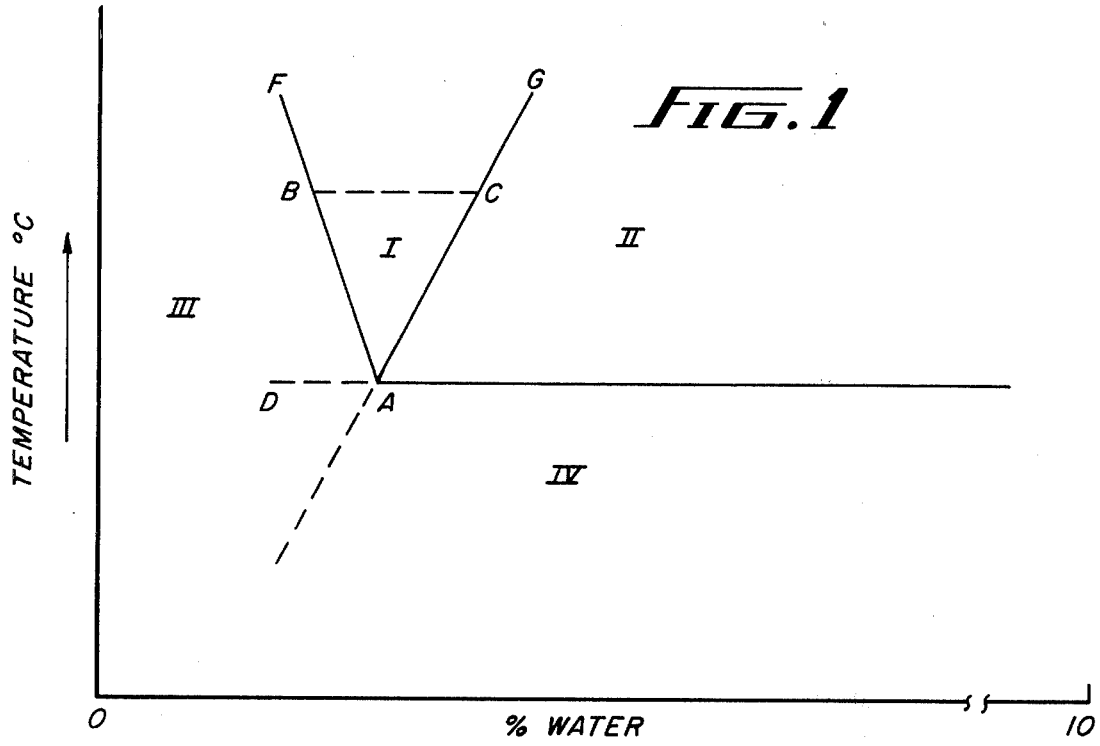
FIG. 1 is a typical phase diagram of an acrylonitrile polymer and water system wherein the abscissa represents the percent water in the acrylonitrile polymer-water system and the ordinate represents the temperature.

In constructing a phase diagram as illustrated by FIG. 1, point A is first located, then lines ABF and ACG are located, after which the preferred portion designated BC is determined to locate the conditions for spinning.

To determine point A, a series of samples of the polymer are exposed to saturated steam in an autoclave for five minutes each. Each sample is exposed to increasing temperatures. The melting point of the polymer in saturated steam is the minimum temperature where flow has occurred. The surface of melted polymer appears glassy and particles of polymer are strongly bonded together. The minimum temperature establishes the line DAE shown in FIG. 1, and is otherwise referred to as minimum single phase fusion melt melting point $T_m$.

Once the melting line DAE is known, the minimum water content necessary for fusion at that temperature is determined. This minimum water content and temperature is point A. At this point all water is bonded to the acrylonitrile polymer and no free water as a second phase exists. A sample of polymer mixed with a known quantity of water is placed into a steel cell equipped with a glass window. The cell is sealed to retain the pressure generated by the test. The cell is heated in an oil bath so that the sample can be observed at all times. In separate tests, samples containing various water-to-polymer ratios are placed in the cell and heated to the temperature indicated by line DAE. When excess water is present, two phases are visible when the polymer melts. Samples of progressively lower water contents are tested until a sample exhibiting only one phase is visible, establishing point A at that concentration. With further reduction in water-to-polymer ratio, melting will not occur at the temperature established by line DAE.

To determine the phase fusion region, it is necessary to establish the lines ABF and ACG as shown in FIG. 1. This is done by placing in the steel cell samples of polymer whose water content in one case contains approximately 5–10% more or less water than the concentration at point A. Line ABF is determined by locating the point which represents the temperature and concentration at which the mixture of polymer and water having the lower amount of water melts into a single phase. Line ACG is established by locating the point at which the two-phase mixture of polymer and water having the greater amount of water becomes a single phase after passing through a two-phase liquid state. Since physical mixing is difficult to obtain in the sealed cell, this latter point may be time consuming to obtain.

After locating point A and lines ABF and ACG, line BC is drawn at a temperature about 10° C. to about 40° C. above the temperature of point A, depending upon the specific temperature at which extrusion is to be conducted. The extreme points B and C at the temperature selected represent, respectively, the minimum and maximum amounts of water that can be present in a single phase fusion melt at the temperature selected.

In FIG. 1, Region I represents those temperature-composition conditions wherein the acrylonitrile polymer and water exist as a single phase fusion melt wherein the water is hydrogen-bonded to the polymer. Region II represents those temperature-composition conditions wherein the polymer and water exist as two separate liquid phases, one being acrylonitrile polymer plus water and the other being free water. Retion III represents single phase solid compositions of polymer plus water. Region IV represents two-phase compositions, one phase being a solid phase of acrylonitrile polymer plus water and the other phase being a liquid water phase. Solid lines ABF, ACG and AE are boundaries between Regions I and III, Retions I and II, and Regions II and IV, respectively, and point A is the minimum single phase fusion melt melting point, all of which are experimentally determined boundary conditions for any specific acrylonitrile polymer.

It will be noted that all of the additional phase diagrams are similar to the generic phase diagram of FIG. 1 although the location of point A and triangular area ABC shift due to differences in chemical composition of the different acrylonitrile polymers. For any given acrylonitrile polymer, the phase diagram can be constructed following the procedure outlined above to locate the water content useful at the particular temperature selected for extrusion.

Once the phase diagram of the selected acrylonitrile polymer and water has been determined, it is next necessary to select a temperature at which extrusion is to be effected. The extrusion temperature for processing the acrylonitrile polymer fiber must be at least about the minimum single phase fusion melting point $T_m$ but preferably is not more than about 40° C. above the minimum single phase fusion melt melting point $T_m$ to avoid deterioration of the acrylonitrile polymer. The particular temperature within the range specified may vary to the extent indicated due to variation in water content of the single phase fusion melt, the extent to which orientation stretching is desired, the manner in which extrusion is effected, the conditions of operation of the pressurized solidification zone, the nature of the acrylonitrile polymer, and other factors. Accordingly, this extrusion temperature cannot be specified precisely and is readily ascertained using the above specification as a guide.

After the extrusion temperature is selected, the quantity of water that is to be used in the single phase fusion melt is determined. Having determined the temperature of extrusion, the range of water concentration which provides a single phase fusion melt at the temperature selected can be determined from the intercepts of the temperature line with the lines ABF and ACG. The intercept of the line ABF is equal to the minimum weight percent of water and the intercept of the line ACG is equal to the maximum weight percent of water. The exact water content within the range specified will be influenced by certain of the variables previously mentioned, and therefore, cannot be precisely given in each instance but can be readily optimized in subsequent operations using the suggested range as a guide.

A single phase fusion melt as that term is used herein means an acrylonitrile polymer-water system which is substantially homogeneous with essentially all of the polymer and water constituting a single melt phase. This condition represents the situation where all of the water present can be bound by the acrylonitrile polymer and sufficient bonding has occurred to lower the melting point of the polymer below the temperature at which deterioration occurs.

Figure 3:
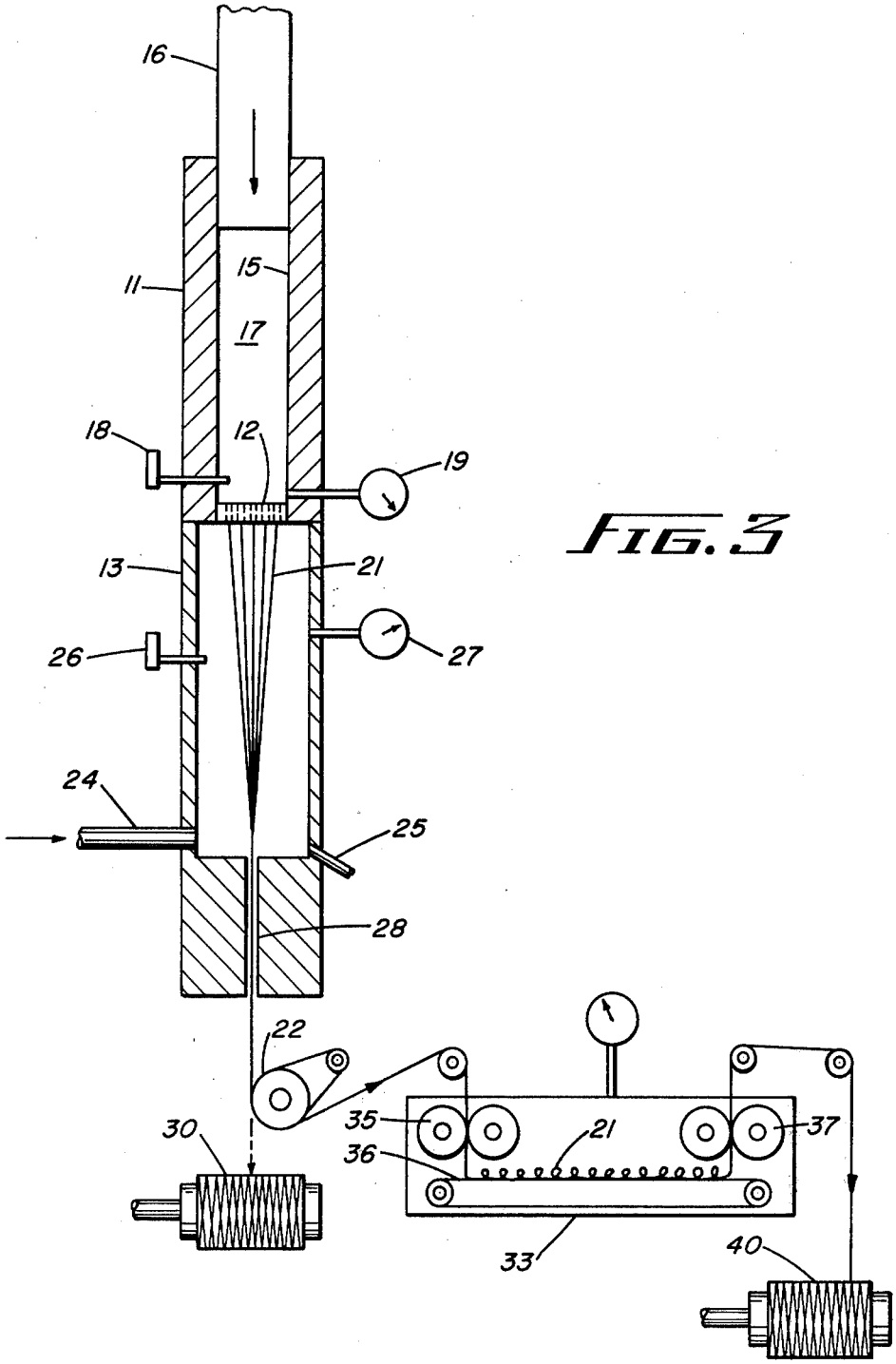
FIG. 3 is a schematic drawing illustrating an embodiment of the process of the present invention.

In FIG. 3, there is shown gnerally an extruder 11 provided with a spinnerette 12 at its outlet and a pressurized solidification chamber 13 positioned to receive extrudate issuing from spinnerette 12. As illustrated, extruder 11 is shown as a piston extruder wherein cylinder 15 is provided with a closely fitted piston 16 moveable by means, not shown, to force the contents of cylinder 15 through spinnerette 12 directly into pressurized solidification chamber 13. With cylinder 15, single phase fusion melt 17 is heated to the proper temperature by heating means, not shown, such as steam jackets or electrical heaters in the walls of cylinder 15. Cylinder 15 is also provided with a thermometer 18 and a pressure gauge 19 for monitoring the temperature and pressure within extruder 11 during melt-spinning. While extruder 11 is shown as a piston extruder, other types of extruders, such as screw extruders, gear pumps, etc., as are known for melt-spinning other organic polymers, may be used.

At the outlet of extruder 11, a spinnerette 12 is mounted. Spinnerette 12 may be provided with circular or noncircular orifices for spinning filaments or fibers. This invention contemplates one or more filaments. A filament issuing from spinnerette 12, here shown as filaments 21, goes directly into pressurized solidification chamber 13 from which it is drawn, under tension, by rapidly rotating godet or thread-advancing rolls 22 which produce the extremely high stretches of this process. Pressurized solidification chamber 13 is provided with an inlet 24 through which steam under pressure and at elevated temperature can be admitted, an outlet 25 from which water can be withdrawn as necessary, and a thermometer 26 and a pressure gauge 27 for monitoring the temperature and pressure within chamber 13. Chamber 13 is also provided at its outlet with a pressure seal 28, illustrated herein as a long thin slot only slightly larger than the diameter of the bundle of filaments 21 passing therethrough. Other pressure sealing devices may be used, illustrative of which are those described in U.S. Pat. Nos. 2,708,843; 2,920,934; 2,932,183; 3,012,427, 3,027,740; 3,037,369; 3,046,773; 3,066,006; 3,083,073; 3,118,154; 3,126,724; 3,137,151;

and 3,152,379, all of which relate generally to continuous relaxation of filaments of acrylonitrile polymers under superatmospheric steam pressure at elevated temperatures.

From godet or thread-advancing rolls 22, which may optionally be located within pressurized chamber 13 or outside thereof as illustrated, filaments 21 may be wound up on yarn package 30 by a suitable winder, not shown, or preferably, filaments 21 may be relaxed in steam chamber 33 wherein steam under superatmospheric pressure and at elevated temperature is permitted to contact filaments 21 under conditions as described in United States Patents listed in the preceding paragraph. In steam chamber 33, filaments 21 are fed through inlet pressure seal, not shown, by inlet rolls 35 onto a conveyor belt 36 where they are conveyed through steam chamber 33 to exit rolls 37 which feed the relaxed filaments through exit pressure seal, not shown, out of steam chamber 33 to be wound onto yarn package 40 by a suitable winder, not shown. Drying of the filaments may be accomplished as the filaments exit the pressurized chamber 13, after packaging, or after relaxing, depending upon the option selected. Drying may be by any convenient means, preferably in an oven at elevated temperature in accordance with conventional procedures wherein both wet and dry-bulb conditions are maintained.

Optionally, the process sequence described above may include additional steps, such as secondary stretching or after drawing, crimping, restretching, washing, treating with antistatic agents, anti-soiling agents, fire-retardants, adhesion promotors, lubricants, etc., dyeing, post-treating chemically, as for cross-linking, staple cutting, and the like to produce such product modifications as these conventional steps are known to produce. In the case of making a fiber as a starting material for a carbon fiber or for fibrillating, relaxing is not preferred. Some of the additional steps may be performed within the same physical structure as the solidification zone, if desired, although under ambient conditions outside those required for the solidification zone. Illustrative of such additional steps performable within the same physical structure as contains the solidification zone may be mentioned secondary stretching or after drawing, relaxing, restretching, pressure dyeing, drying, etc. Usually, but not necessarily, such additional steps would be performed under elevated pressure.

This invention and additional advantages thereof will be further understood by reference to the following illustrative examples which illustrate preferred embodiments thereof. All parts and percentages are by weight unless otherwise indicated.

Kinematic average molecular weight ($M_k$) is obtained from the following relationship: $\mu = 1/A\ M_k$ wherein $\mu$ is the average effluent time (t) in seconds for a solution of 1 gram of the polymer in 100 milliliters of 53 weight percent aqueous sodium thiocyanate solvent at 40° C. multiplied by the viscometer factor and A is the solution factor derived from a polymer of known molecular weight and in the present case is equal to 3,500.

EXAMPLE 1

Figure 2A:
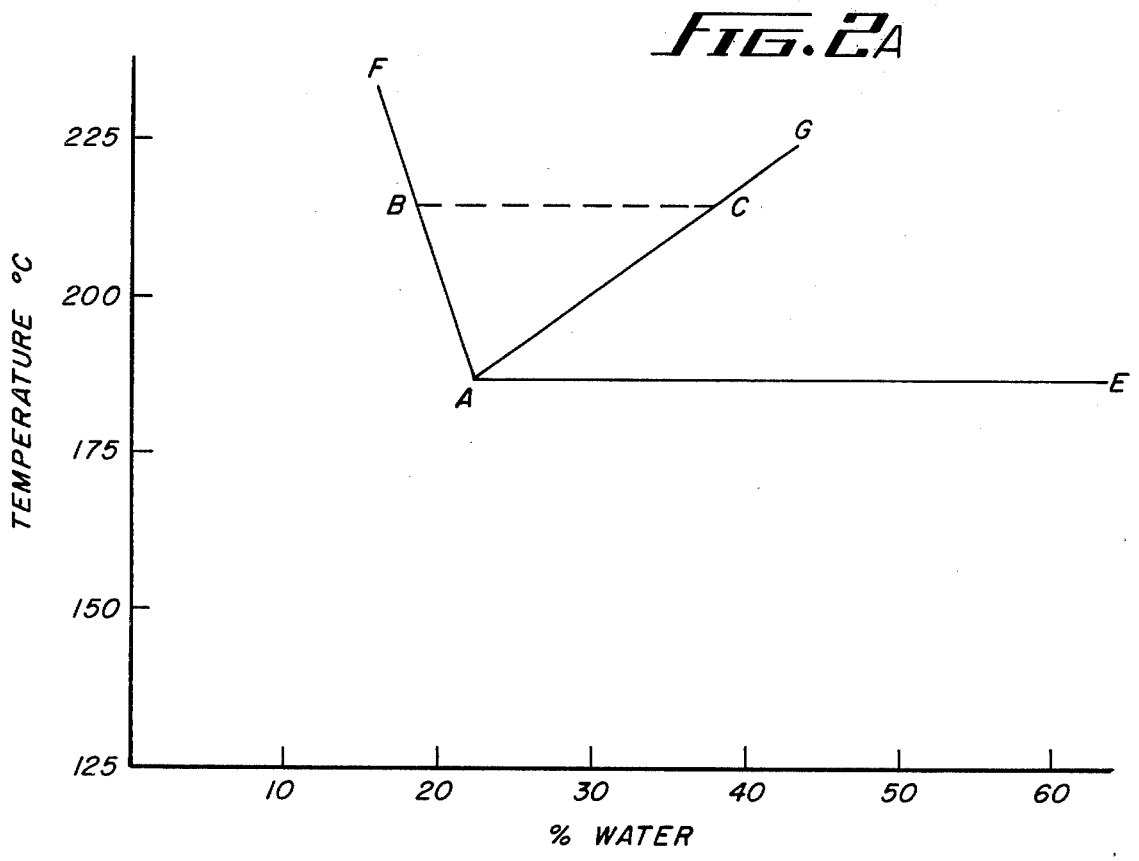
FIG. 2A represents the phase diagram of an acrylonitrile polymer-water system wherein the acrylonitrile polymer is a homopolymer of acrylonitrile.
Figure 2B:
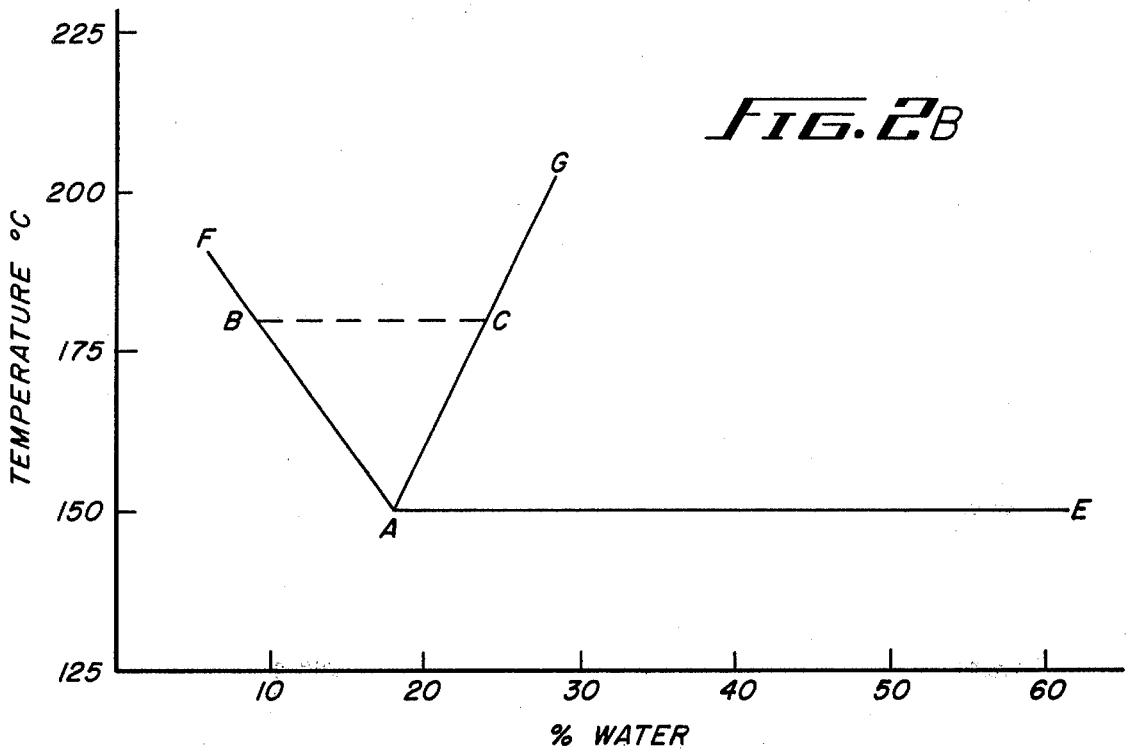
FIG. 2B represents the phase diagram of another acrylonitrile polymer-water system wherein the acrylonitrile polymer is a copolymer of 89.3% acrylonitrile and 10.7% methyl methacrylate by weight.
Figure 2C:
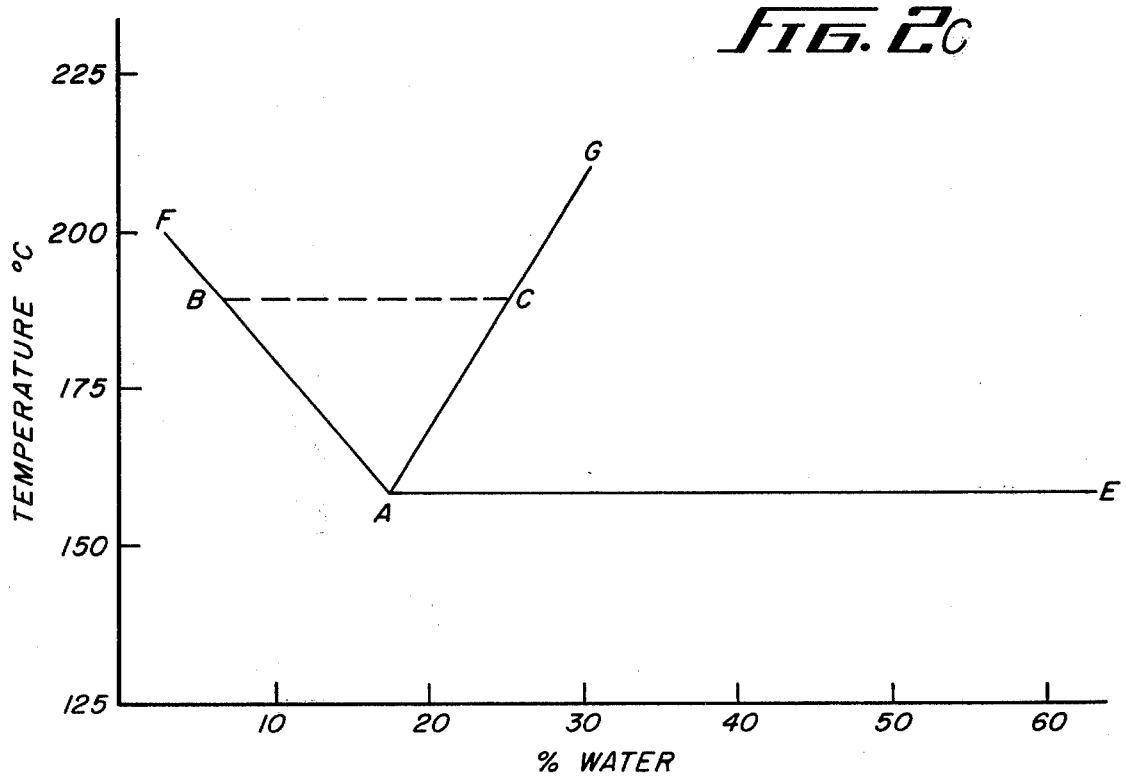
FIG. 2C represents the phase diagram of another acrylonitrile polymer-water system wherein the acrylonitrile polymer is a copolymer of 69.0% acrylonitrile, 25.0% vinylidene chloride, and 6% hydroxethyl acrylate by weight.

The phase diagram for an acrylonitrile polymer-water system wherein the acrylonitrile polymer was a copolymer of 89.3 weight percent acrylonitrile and 10.7 weight percent methyl methacrylate and had a kinematic molecular weight (Mk) of approximately 58,000 was determined as described hereinabove. The resulting phase diagram illustrated in FIG. 2B herein shows that a single phase fusion melt region of temperature and composition exists in the triangular area ABC thereon which can usefully be melt-spun into shaped articles. Having determined the phase diagram for mixtures of this polymer and water, as shown in FIG. 2B, the following melt-spinning was conducted using apparatus substantially as schematically illustrated in FIG. 3.

To 15 grams of dry polymer were added 3.3 grams of water thus providing an acrylonitrile polymer-water mixture containing 18% water. The mixture was sealed in a jar and mixed on a roll-mill for 30 minutes to ensure complete blending. The blended mixture was then placed in a piston extruder 11 equipped with a spinnerette 12 having a single orifice of 16 mils diameter and 128 mils orifice length. The orifice opening was temporarily sealed to prevent any premature loss of moisture during start-up. The extruder 11 and spinnerette 12 were heated to 154° C. Under sufficient pressure to prevent water vaporization. The spinnerette orifice was unsealed and 800 psi of force was applied by piston 16 in order to extrude a filament at a rate of 0.446 meters per minute.

Pressurizable solidification chamber 13 had previously been sealed and saturated steam had been introduced through inlet 24 until a pressure of 38 psi gauge, corresponding to a temperature of 140° C., prevailed. This temperature was 140° C., that is, 14° C. below the fusion melt temperature in the extruder and about 10° C. below the minimum fusion melt melting temperature ($T_m$) of 150° C. for this polymer. Under these conditions, the maximum take-up speed achieved was 38 meters per minute for a draw-down stretch ratio of 85 (8,500% stretch). A quantity of fiber so produced, having a denier per filament of 15, was collected and relaxed in saturated steam under pressure at 127° C. in a free-to-shrink condition in an autoclave. The denier increased to 19.5, indicating that about 23% shrinkage was achieved during relaxation. Physical properties of this relaxed fiber were:

| | |
|---|---|
| Straight tenacity | 3.5 grams/denier |
| Straight elongation | 43.0% |
| Loop tenacity | 1.98 grams/denier |
| Loop elongation | 19% |
| Initial modulus | 58.0 grams/denier |

These fiber properties and the fine filament denier indicate a textile fiber eminently suitable for use as a carpet fiber.

COMPARATIVE EXAMPLE A

The composition and apparatus used in Example 1 was again employed except that solidification chamber 13 was maintained at atmospheric conditions so that the filament 21 was extruded into a region of ambient temperature and pressure. Pressure on piston 16 was adjusted so that the flow rate of fusion melt through the spinnerette orifice was 0.446 meters per minute, the same flow rate achieved in Example 1. The resulting filament was taken up on yarn package 30 on a rotating winder. After starting up, the speed of the winder was gradually increased until a maximum, determined by continuing filament breakage was reached. The maximum take-up speed achieved was 1.16 meters per minute for a draw-down stretch ratio of 2.6 (260% stretch). The filament denier was approximately 500 and the fiber was unsatisfactory for textile use. Properties were poor due to the lack of adequate orientation stretch.

EXAMPLE 2

The procedure of Example 1 was repeated except that the flow rate of single phase fusion melt through through the spinnerette orifice was 0.792 meters per minute and the steam pressure in the solidification chamber was increased to 49 psig, corresponding to a temperature of 147° C. This temperature was about 7° C. below the temperature in the extruder and about 3° C. below the minimum melting point $T_m$ of the single phase fusion melt. Under these conditions, the maximum take-up speed achieved was 89 meters per minute for a stretch ratio of 112 (11,200%). The denier of the filament obtained was 6.4 and its physical properties were substantially the same as those of the fiber of Example 1, thus indicating a textile fiber for apparel applications.

COMPARATIVE EXAMPLE B

The procedure of Example 1 was again followed except for conditions maintained in the solidification chamber. In this run a strip heater was installed along the full length of the solidification chamber. With the solidification chamber vented to the atmosphere and the strip heater set to provide an air temperature of 150° C. in the solidification chamber, which conditions closely simulate those employed in conventional melt-spinning of other organic fibers to obtain adequate spin draw-downs, a filament-like material was obtained which appeared to be completely filled with bubbles, resembling an elongated foam. The maximum stretch ratio achieved was the same in Comparative Example A, 2.6., and frequently, breakage of the highly non-uniform material occurred. This run demonstrated that elevated temperature without the environment of steam under pressure was not capable of providing the extremely high stretch ratios of the present invention, but instead provided a foamed product that is not useful for textile applications.

COMPARATIVE EXAMPLE C

The procedure of Example 1 was again followed except for conditions maintained in the solidification chamber. In this run, nitrogen under 56 psig was employed at ambient temperature in the solidification chamber. The linear velocity of the fusion melt through the spinnerette was 0.634 meters per minute and the maximum take-up speed that could be achieved was 2.9 meters per minute for a draw-down ratio of 4.6 (460% stretch). Although this stretch ratio was slightly higher than that achieved in Comparative Example A, which was run under ambient pressure and temperature, the stretch ratio actually achieved was far short of that necessary for proper orientation without the use of subsequent after-stretching steps. The fiber denier was too great (about 445) to consider for textile uses and insufficient stretch was obtained for good fiber properties.

COMPARATIVE EXAMPLE D

The procedure of Example 1 was again followed except for conditions in the solidification chamber. In this run the strip heater used in Comparative Example B was employed to heat pressurized nitrogen (56 psig) to various temperatures. As the temperature was increased from ambient to 140° C., the stretch ratio achieved at maximum draw-down rose from 4.6 to 10.1. No increase in stretch ratio at maximum draw-down occurred as the temperature was further increased to 150° C. Heating to above 150° C. caused filament melting resulting in discontinuity and breakage of the filament. This run illustrated that elevated temperature and pressure without the presence of steam do not provide the high stretch ratio in draw-down achieved by the present invention. The fiber obtained was of too high a denier (about 125) to be considered for textile uses.

COMPARATIVE EXAMPLE E

This example illustrates the process of U.S. Pat. No. 3,984,601 (Blickenstaff) using in Part A, acrylonitrile polymer and water to obtain a fusion melt spinning composition and in Part B, acrylonitrile polymer, water, and ethylene carbonate to obtain a fusion melt spinning composition, ethylene carbonate being a compatible solvent for the polymer. In each part, the same polymer is employed and has the composition 93.63% acrylonitrile, 6% methyl acrylate, and 0.37% sodium styrene sulfonate.

Part A. The polymer is mixed with water at a ratio of 100/26.5, respectively. The mixture is fed to an extruder during which processing it is converted to a homogeneous melt. The melt is delivered from the extruder to a spinnerette having orifices of 0.15 mm diameter and 0.15 mm length. The melt at 172° C. is extruded into a conditioning chamber 20 cm. long which is fed room temperature air to maintain a pressure of 20 psig to result in a temperature of 140°–150° C. The continuous filament spun is wound at 96 m./min. The filament obtained is then subjected in a separate operation to drawing in saturated steam at 120° C. to three draw ratios, 6X, 8X, and 12X, corresponding to 600%, 800%, and 1200% of its as-spun length, respectively. The resulting single filaments are boiled off and the properties determined are tabulated below.

Part B. The procedure of Part A above is followed in all essential details except that the copolymer is mixed with water and ethylene carbonate in the ratio of 100/25.8/3.23, respectively; the conditioning chamber is 15 cm. long; and the temperature therein is 140° C. The continuous filament spun is wound at 96 m./min. the filament obtained is then subjected in a separate operation to drawing in saturated steam at 120° C. to three draw ratios 6X, 8X, and 11.5X. Boiled-off filament properties are also given in the tabulation below.

FIBER PROPERTIES

| Filaments of Part | Draw Ratio | Denier | Straight Tenacity | Straight Elongation | Loop Tenacity | Loop Elongation |
|---|---|---|---|---|---|---|
| A | 6 | 17 | 3.67 g/d | 26% | 0.67 g/d | 1.6% |
| A | 8 | 11.9 | 4.56 | 22.8 | 0.83 | 2.1 |
| A | 12 | 8.2 | 5.24 | 19.6 | 0.81 | 1.7 |
| B | 6 | 9.9 | 3.96 | 28.4 | 0.8 | 2.0 |
| B | 8 | 7.6 | 4.28 | 24.1 | 1.50 | 9.0 |
| B | 11.5 | 5.5 | 4.99 | 21.9 | 1.30 | 6.9 |

A comparison of the loop properties of fibers of Part A with those of the fiber of Example 1 clearly show the improved properties obtained by the present invention when no polymer solvent is employed. Similar comparisons of the loop properties of fibers of Part B with those of the fiber of Example 1 also show that fiber properties obtained by the process of the present invention using no polymer solvent are better than those obtained by the reference using polymer solvent.

EXAMPLE 3

To 83.3 parts of acrylonitrile copolymer of 89.3% acrylonitrile and 10.7% methylmethacrylate of kinematic viscosity molecular weight (MK) of 58,000 were added 16.7 parts of water, the polymer weight being on a bone-dry basis. The polymer-water mixture was processed into a single phase fusion melt and extruded through a spinnerette having 16 orifices, each of 305 mils in diameter and a capillary length to diameter ratio of 2.0. Extrusion was conducted at 177° C. and the group of filaments issued directly into a solidification zone maintained at 32 psig (136° C.) with saturated steam. Orientation stretch was effected in one stage at a stretch ratio of 28.9 relative to the linear flow of fusion melt through the spinnerette. Following subsequent processing as in Example 1, desirable fiber was obtained.

I claim:

1. A process for preparing an acrylonitrile polymer fiber which comprises: extruding a single phase fusion melt of an acrylonitrile copolymer and water through a spinnerette directly into a steam-pressurized solidification zone wherein the temperature, pressure, and saturation of steam are maintained so that the nascent extrudate solidifies, remains in a stretchable state sufficient to achieve a total stretch ratio of at least about 25, relative to the linear flow of said fusion melt through said spinnerette, and the amount of water retained in said extrudate is sufficient to maintain the nascent extrudate in a plastic state; stretching said nascent extrudate while in said solidification zone at a total stretch ratio of at least about 25 relative to the linear flow of said fusion melt through said spinnerette; and thereafter drying the resulting extrudate.

2. The process of claim 1 wherein the stretch ratio is about 50 to 150.

3. The process of claim 1 wherein the additional step of relaxing the stretched extrudate is conducted.

4. The process of claim 1 wherein the acrylonitrile polymer contains methyl methacrylate comonomer.

5. The process of claim 1 wherein the steam pressure in said solidification zone is in the range of about 5 to 125 psig.

6. The process of claim 1 wherein the steam pressure in said solidification zone is in the range of about 30 to 95 percent of the steam pressure corresponding to the minimum melt temperature of the polymer-water mixture.

* * * * *